United States Patent [19]

Misuna

[11] 3,999,239

[45] Dec. 28, 1976

[54] DEVICE FOR CLEANING PRINTING ROLLERS

[76] Inventor: Takeo Misuna, 17-9, 2-chome, Miyakojimanakadori, Miyakojima, Osaka, Osaka, Japan

[22] Filed: Oct. 14, 1975

[21] Appl. No.: 621,760

[30] Foreign Application Priority Data

Oct. 14, 1974 Japan ..... 49-124096

[52] U.S. Cl. ..... 15/88; 15/21 R; 15/256.52; 51/56 R

[51] Int. Cl.[2] ..... A47L 25/00; B41F 35/02

[58] Field of Search ..... 15/21 C, 21 R, 88, 3, 15/97 R, 104.04, 70, 256.52; 101/425; 51/49, 56; 134/153, 6

[56] References Cited

UNITED STATES PATENTS

| | | | |
|---|---|---|---|
| 2,690,577 | 10/1954 | Coninx | 15/88 X |
| 3,889,424 | 6/1975 | Buhayar | 51/49 |

*Primary Examiner*—Edward L. Roberts

*Attorney, Agent, or Firm*—George B. Oujevolk

[57] ABSTRACT

A device for cleaning printing rollers. This device is capable of effectively cleaning rollers through a brushing process and a washing-drying process, the former process being conducted in a liquid-cleanser-contained tub wherein a sandpaper-brush or a wire-brush makes a pressing contact with a roller to be cleaned in the state that said brush rotates around a vertical axis simultaneously moving to and from axially along the roller, the roller resting on a pair of parallel rollers keeping a suitable distance between them and being disposed axially parallel with the roller to be cleaned, the pair of rollers in this state transmitting their motorized rotation to the roller to be cleaned so as to add to the brushing effect, the brushed roller thence being placed under a washing-and-drying process at the other tub wherein a showering device and a blade function effectively for the washing and drying work respectively.

3 Claims, 5 Drawing Figures

DEVICE FOR CLEANING PRINTING ROLLERS

This invention relates to a device for cleaning printing rollers and more particularly a device which can clean every nook and corner of the rollers without a complex mechanism, said cleaning being conducted separately in two tubs, one for brushing as the first process and the other for washing-drying as the finishing touches, said first process being particularly characterized in the manner of using a detachable brush by choice and in the way of rotating and moving said brush so as to make the best use of its brushing effect through its frictional contacting with the roller to be cleaned.

A printing machine usually incorporates three functionally-differentiated rollers, i.e. one for feeding ink, the other for watering the printing plate, and further another for removing dusts out of said plate, the first one usually being made of rubber, the second one also being materialized by rubber but covered with water-absorbent material such as a towel and the like, and the third one comprising dust-absorbent material, for example, natural or synthetic leather, or natural or synthetic fiber, at its outward portion.

These rollers as a matter of course need cleaning after each usage, with a flat blade tool like a doctor being applied conventionally to the removal of ink coagulation in such a manner that said doctor scrapes the coagulation off the roller surface. Or, otherwise, the dirt or blots brushed off by a cylindrical brush with the use of liquid cleanser in rotating contact between the brush and what is to be cleaned.

The above-mentioned cleaning, however, has proven insufficient for maintaining said rollers in a spotless state, the accumulated ink coagulation sometimes leading such rollers to unusable state even when they have undergone said cleaning treatments, said insufficiency being partly attributable to the application of a same cleaning brush to every one of these functionally-differentiated rollers and partly to the simplicity in the manner of using the brushing device.

This invention device is characterized in that either one of two kinds of brushes is incorporated detachably therein, the choice of said brushes depending on the kind of roller to be cleaned, said brush being so disposed as to make a pressing contact with said roller in the state that said brush rotates round a vertical axis simultaneously moving axially to and from along said rollers, said roller also being kept in a rotary movement so as to add to the brushing effect.

A first object of this invention is to provide a device for effectively cleaning printing rollers, said device comprising a brush disposed so as to make pressing contact with a roller to be cleaned in the state that said brush rotates round a vertical axis simultaneously moving axially to and from along the roller, the roller also being kept in a rotary movement to add to the brushing effect by said brush thereby enabling the complete removal of ink remnant from every nook and corner of said roller. A second object of this invention is to provide a device for cleaning printing rollers wherein a sandpaper-brush or a wire-brush is detachably incorporated therein in alternation, choice of the brush having to be determined by the kind of roller to be cleaned.

In order that this invention may be readily understood, a reference will be made to the annexed drawings which illustrate this invention in various examples, wherein.

In the description given herein the "roller to be cleaned" will be designated as "roller A".

Figure 1:
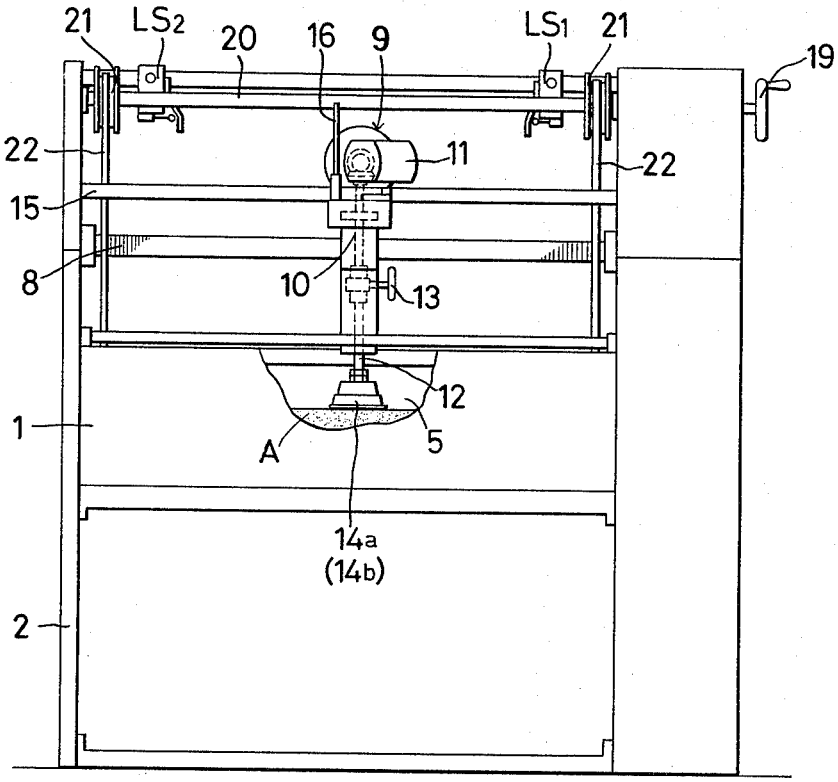
FIG. 1 is an internally-partially-broken front elevation of the invention contemplated herein.
Figure 2:
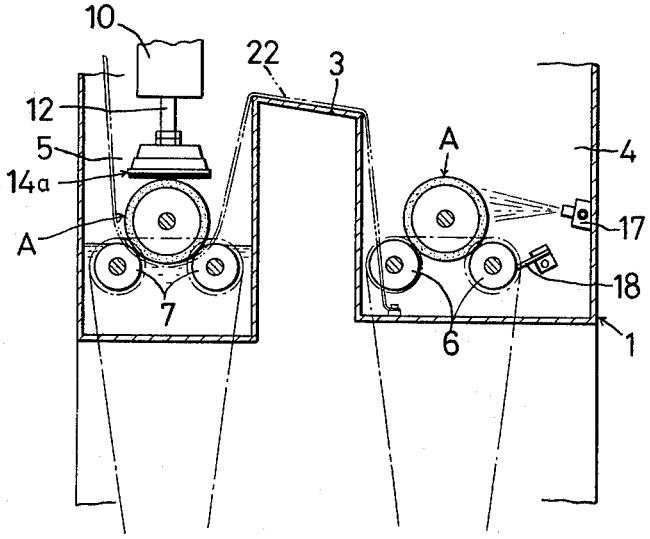
FIG. 2 is a longitudinal sectional view in magnified scale of main parts of the invention contemplated herein.

In FIGS. 1 and 2, numeral 1 designates a tub disposed intermediately in a casing 2 of the device, said tub 1 being divided into a washing-drying tub 4 and a brushing tub 5 separated from each other by a partioning wall 3 provided in between them.

As shown in FIG. 2, within said tub 4 are a pair of rollers 6 parallel with each other in the axial direction and keeping a suitable distance between them so that a roller A to be cleaned may rest suitably on said rollers 6.

In tub 5 also are installed a pair of rollers 7 parallel with each other axially and at a suitable distance between them for the same purpose.

The foregoing rollers 6 and 7 may be driven in their rotary movement by motors (not shown) thereby transmitting the rotation to said roller A.

At the upper portion of casing 2 wherein it is open upward, a rack 8 horizontally extends in casing 2 from one end wall to the other end wall in the state of penetrating at right angles through a cylindrical covering 10 of a vertically provided brush-driving mechanism 9. Said mechanism 9 comprises a rotary shaft 12 which vertically extends through covering 10 crossing the path of said rack 8 within covering 10, shaft 12 being detachably fitted at its lower end with a sandpaper-brush 14*a* or wire-brush 14*b* being capable of rotating axially and also moving horizontally to and fro along said rack 8 so that the attached brush 14*a* or 14*b* may contact rotationally with a roller A from one end to the other end thereof in the brushing operation, the foregoing movement being powered by a motor 11 mounted at the top of shaft 12. A pinion (not shown) engaging with rack 8 and a gear (not shown) for transmitting rotation of motor 11 to pinion are installed within said covering 10 thereby enabling the horizontal movement of mechanism 9 and switches LS1 and LS2 are provided at predetermined positions within casing 2 so that the rotation of motor 11 may turn when said mechanism 9 reaches any of said switches, the traveling distance of said mechanism 9 in between switches LS1 and LS2 being equivalent to the length of brushing applied to a roller A.

Said shaft 12 is further powered to contact upwardly within said covering 10 by the rotary operation of a handle 13 fixed to covering 10 at its outer periphery, and also to move pivotally around said rack 8 either forward or rearward by the operation of the other handle 16 disposed beside said covering 10 at its upper portion, both of the above functions facilitating the fitting or removal of brush 14*a* or 14*b* to and from shaft 12 and also the setting of said brush on and off the roller A. Said mechanism 9, however, needs only one-way pivotal movement for the afore-mentioned purpose, either forward or backward, and accordingly mechanism 9 is held at the upper end of covering 10 by a bar 15 extending parallel with rack 8 as manifested in FIG. 1.

The washing-drying tub 4 is arranged with a showering device 17 for jetting water over the brushed roller A propped on said pair of rollers 6, and a flat knife on doctor 18 for scraping one of said rollers 6 at its watery surface so as to add, although indirectly, to the drying effect of said roller A at the finish of the washing process.

The roller A at the finish of brushing in tub 5 may be shifted to tub 4 by means of a pair of belts 22 fixed at their upper ends each to a pair of rotary members 21 each sustained by a shaft 20 at both ends thereof, said shaft 20 extending from side to side inside said casing 2 along and above said bar 15. Said belts 22 are each fixed at their lower ends to the bottom of said tub 4 in the state that said pair of belts 22 abut upon one of said pair of rollers 6 at both ends of their axes, in the above-mentioned state said belts 22 stretching through said tube 5 passing through space between said roller A and said rollers 7 at both end portions of their respective axes which project by a suitable length respectively from said rollers. Thus, said belts 22 may lift and shift said roller A from said tub 5 to the neighboring tub 4 upon rotating shaft 20 and accordingly said members 21 by manually rotating a handle 19 fitted to casing 2 at the outside upper portion resulting in the winding of belts 22 around said members 21.

As referred to already, the choice of brush **14*a* or 14*b* may be determined by the kind of roller A, the sandpaper-brush 14*a* being proper for the inkfeeding roller and the wire-brush 14*b*** for the waterfeeding roller and dust-removing roller.

Figure 5:
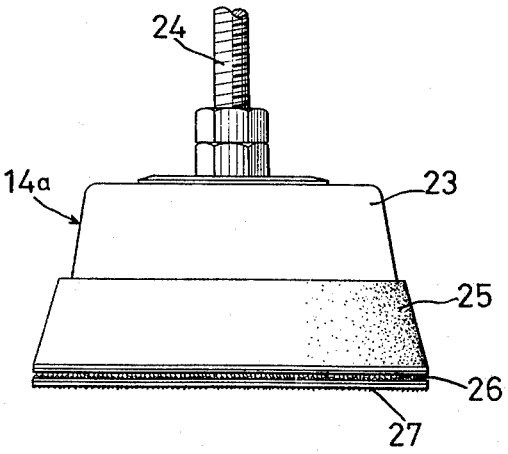
FIG. 5 is a front elevation of a sandpaper-brush in magnified scale.

The sandpaper-brush **14*a*, as clarified in FIG. 5, comprises a base member 23, an axis 24 projecting upwardly from said base 23 so as to be detachably fitted to the afore-mentioned rotary shaft 12, and a thick layer of sponge 25 such as of rubber, synthetic resin and etc. fixing to said base 23 at its underside surface, said items 23 and 25 forming a truncated cone as shown in said drawing. Sandpaper 27 is detachably furnished to the above-mentioned brushing body via a medium material 26 such as velveted "hook and eye" fastener with the use of any suitable adhesive, said sandpaper 27** also being to be choiced so as to be best adaptable for the surface condition of the roller A.

Figure 4:
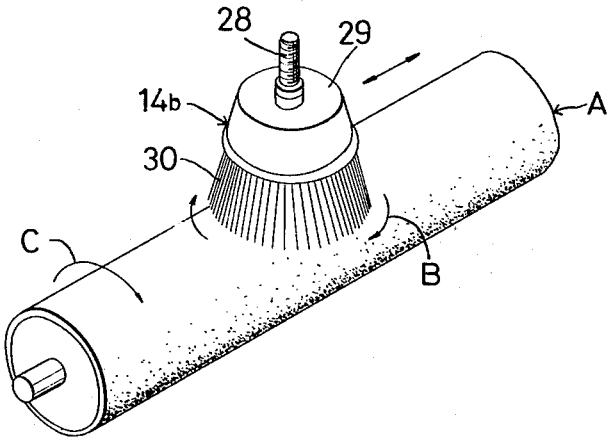
FIG. 4 is a perspective view of a wire-brush in action in relation to a roller to be cleaned in a rotary movement.

The wire-brush **14*b*, shown in FIG. 4, comprises a base member 29 also forming like a truncated cone, an axis 28 erecting therefrom at its upper surface to be detachably fitted to the afore-mentioned rotary shaft 12, said base member 29 having a bundle of wires 30** fixedly attached thereto at the underside surface.

The device of this invention as described hereinbefore may be used as follows:

A roller A for feeding ink, usually made of rubber, is placed on the pair of rollers 7 inside the brushing tub 5 wherein liquefied cleanser is contained to the depth of narrowly dipping said rollers 7.

With the fitting of brush **14*a* so as to make a pressing contact with a roller A in tub 5, driving mechanism 9 is set on by pushing a starting switch (not shown), whereby said motor 11 drives said sandpaper brush 14*a* into rotary movement simultaneously moving it axially along said roller A in a distance between the afore-mentioned switches LS1 and LS2, said switches working to turn the rotating direction of said motor 11, concurrently the equipped pair of rollers 7 starting on their own motorized rotation and accordingly transmitting the rotary movement to roller A propped on rollers 7 between their outer peripheries at their inward upper portions, as illustrated in FIG. 2**.

Figure 3:
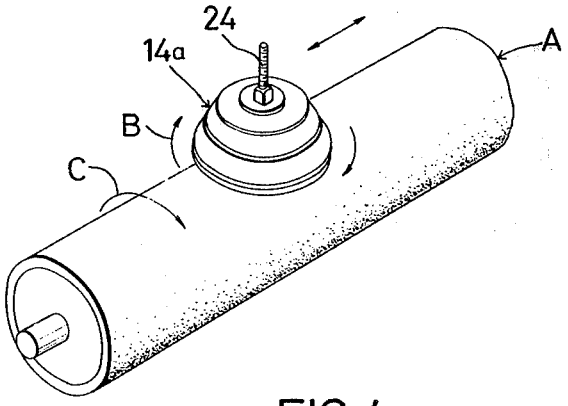
FIG. 3 is a perspective view of a sandpaper-brush in action in relation to a roller to be cleaned in a rotary movement.

The foregoing operation is further illustrated in FIG. 3 wherein brush **14*a* is shown rotating clockwise as indicated by arrow B simultaneously moving axially to and fro along roller A keeping a pressing contact therewith while roller A rotates in the direction indicated by arrow C, in this brushing process brush 14*a* wipes off ink coagulation at every nook and corner of roller A. Thence, as power is turned off, mechanism 9 is pivotally moved at its lower end rerward or forward around the afore-mentioned rack 8 by the operation of handle 16 so that sandpaper-brush 14*a* may come off from roller A, followed by winding of said belts 22 by the handling of the other handle 19 so as to lift up said roller A and shift it into washing-drying tub 4 whereby said roller A rests on said pair of rollers 6**.

As a matter of course, belts 22 are loosened at this stage, followed by the motorized rotation of rollers 6 resulting in the transmitted rotation of roller A simultaneously the showering device 17 equipped in tub 4 showering water thereby washing off every fractional remnants of scraped dirts that survived the preceding brushing process.

After completion of the watered washing, roller A is kept rolling to facilitate its drying, with a doctor 18 projecting from one of the side walls inside said tub 4 scraping one of the watery rollers 6 at its outer periphery thereby adding to the drying effectuated in the above-mentioned process.

FIG. 4 illustrates brushing by a wire-brush **14*b* to be applicable properly to a roller A for feeding water to a printing plate, this roller A comprising rubber also but having a covering made of a water-absorbent material such as a towel and the like, the movement of brush 14*b* as well as roller A being no different from that of sandpaper-brush 14*a***.

When brushing another roller A, that is for removing dust out of the printing plate, this second roller A is preferably placed under the two-way brushing, i.e. brushing by the sandpaper-brush **14*a* and the wire-brush 14*b*** in succession, the following washing-drying treatment being applied in the same way as in case of the former.

As described hereinbefore, this device brushes a printing roller to be cleaned through a pressing contact between a brushing equipment and said roller such that said brushing equipment rotates around a vertical axis simultaneously moving around a horizontal axis and said roller to be cleaned rotating around a horizontal axis thereby causing a multiplication of the brushing effect by the brush on the roller as compared to the conventional brushing simply in one rotating direction, also the use of two kinds of brushes according to the kind of the roller to be cleaned further contributing to the efficiency as required for the cleaning. Moreover, this invention obviates the use of the usual grinding stone which is likely to cause abrasion or other damage on the roller but is used when said roller has a great deal of ink accumulation.

What is claimed is:

1. A device for cleaning printing rollers, said device comprising means supporting and rotating a roller to be cleaned, a disc-shaped cleaning member having an axis of rotation perpendicular to the axis of a roller mounted on said device and positioned to make pressing contact with the outer periphery of a roller positioned on said supporting and rotating means, means to rotate said cleaning member about its axis, and means to move said cleaning member along the outer periphery of said roller while in pressing contact with a roller simultaneously with said cleaning member rotation.

2. A device for cleaning printing rollers as claimed in claim 1 wherein said cleaning member has sandpaper detachably mounted on the roller contacting portion thereof.

3. A device for cleaning printing rollers as claimed in claim 1 wherein said cleaning member comprises wire bristles on the roller containing portion thereof.

* * * * *